United States Patent [19]

Marentic et al.

[11] Patent Number: 4,464,657

[45] Date of Patent: Aug. 7, 1984

[54] MODULAR WAVEFORM GENERATOR FOR PLASMA DISPLAY PANELS

[75] Inventors: Michael J. Marentic, Orange; Daniel A. Manseau, Garden Grove, both of Calif.

[73] Assignee: Interstate Electronics Corp., Anaheim, Calif.

[21] Appl. No.: 273,092

[22] Filed: Jun. 12, 1981

[51] Int. Cl.[3] ..... G09G 3/28

[52] U.S. Cl. ..... 340/776; 315/169.4; 340/767; 340/779; 340/799; 340/805

[58] Field of Search ..... 340/713, 767, 771, 776, 340/779, 805; 315/169.4

[56] References Cited

U.S. PATENT DOCUMENTS

| | | | |
|---|---|---|---|
| 4,021,607 | 5/1977 | Amano | 315/169.4 X |
| 4,030,091 | 6/1977 | Ngo | 340/776 X |
| 4,183,062 | 1/1980 | Weisbrod | 340/776 X |

*Primary Examiner*—David L. Trafton

*Attorney, Agent, or Firm*—Knobbe, Martens, Olson & Bear

[57] ABSTRACT

Complex waveforms used to control a plasma panel are formed as sequences of common elemental waveform modules. These modules are combined in various orders into strings capable of performing various functions on the plasma panel. Large scale parallel addressing is accomplished by forming a string of several sustain modules, followed by a write or erase module.

33 Claims, 10 Drawing Figures

| 50a & 50b | 12a & 12b | ADDRESS GROUP | ROM ADDRESS | FUNCTION |
|---|---|---|---|---|
| 0 0 | 0 0 | 1 | 0 - 63 | BULK ERASE |
| 0 0 | 0 1 | 2 | 64 - 127 | ERASE |
| 0 0 | 1 0 | 3 | 128 - 191 | WRITE |
| 0 0 | 1 1 | 4 | 192 - 255 | SUSTAIN |
| 0 1 | 0 0 | 5 | 256 - 319 | NOT USED |
| 0 1 | 0 1 | 6 | 320 - 383 | |
| 0 1 | 1 0 | 7 | 384 - 447 | |
| 0 1 | 1 1 | 8 | 448 - 511 | |
| 1 0 | 0 0 | 9 | 512 - 575 | |
| 1 0 | 0 1 | 10 | 576 - 639 | FIRST 20 μ SEC. OF DISTRIBUTED CONDITIONING |
| 1 0 | 1 0 | 11 | 640 - 703 | |
| 1 0 | 1 1 | 12 | 704 - 767 | |
| 1 1 | 0 0 | 13 | 768 - 831 | SECOND 20 μ SEC. OF DISTRIBUTED CONDITIONING |
| 1 1 | 0 1 | 14 | 832 - 895 | |
| 1 1 | 1 0 | 15 | 896 - 959 | |
| 1 1 | 1 1 | 16 | 960 - 1023 | |

Fig. 2A

MODULAR WAVEFORM GENERATOR FOR PLASMA DISPLAY PANELS

BACKGROUND OF THE INVENTION

Plasma display panels are presently in commercial use as digitally addressable information display devices. The panel itself typically consists of two glass plates with a gas mixture sealed between them. A plurality of X-axis electrodes extend in a mutually parallel array on an interior substrate of one plate, and a plurality of Y-axis electrodes extending in a mutually parallel array on the interior of the other plate. The X-axis electrodes are at a 90° angle to the Y-axis electrodes, thereby forming a plurality of intersections between the X-axis and Y-axis electrodes. A typical commercially available AC plasma panel has 512 X-axis electrodes and 512 Y-axis electrodes, yielding 262,144 intersections, or cells.

When a voltage of between 180 to 200 volts is applied across an X-axis electrode and a Y-axis electrode, a discharge in the gas occurs at the cell formed by the electrodes, causing a pulse of light to be emitted at this point. Simultaneously, a charge is collected on the cell wall, which results in the cell being an "on" cell. Once such a discharge has been produced and the cell is turned "on", the collected wall charge acts to continue the discharging when a lesser AC sustain voltage is applied between the electrodes. In an "on" cell, the gas will discharge and the cell will emit a pulse of light at each transition of the applied AC sustain waveform. The sustain voltage, however, is insufficient to initiate a discharge at an X-Y intersection. This phenomenon is known as inherent memory, and was originally disclosed by Baker et al, U.S. Pat. No. 3,499,167, and by Bitzer et al, in U.S. Pat. No. 3,959,190. By precisely timing, shaping, and phasing multiple alternating voltage waveforms supplied to X and Y axes electrodes, the generation, sustaining and erasure of light emitting gas discharges at selected locations on the plasma display panel can be controlled.

Four functions are used to control the operation of an AC plasma panel: the write function, the erase function, the sustain function, and the bulk-erase function. The write function causes a selected cell on the panel to change from the "off", or non-light emitting state, to the "on" or light emitting state. The sustain function maintains the state of all cells on the panel, i.e. causes "on" cells to remain on, and "off" cells to remain off. The sustain function also causes the "on" cells to emit light. The erase function causes a selected cell to be changed from the "on" state to the "off" state. The bulk-erase function causes all "on" cells in the panel simultaneously to be changed to the "off" state.

Operation of the write, erase, sustain, and bulk-erase functions is generally controlled by four logic signals: the X-sustain signal XS, the Y-sustain signal YS, the X-address pulse XAP, and the Y-address pulse YAP. These signals, generally supplied by a waveform ROM (Read Only Memory), are digital pulse trains typically recurring at a frequency of 50 kHz. The logic signals are supplied to the sustain and drive circuits, and cause the circuits to execute the four control functions on the panel. Since the typical operational frequency of the plasma display system is 50 kHz, the complex waveform for each of the four control functions is executed in a 20 microsecond period. It has been found necessary, in the prior art, to have all four functions of an equal length since one ROM is used to store them, and addressing is less complex for the constant length.

This 20 microsecond period is a compromise, since the amount of time needed for the various operations varies. For example, the amount of time needed for a sustain cycle is about 15 microseconds, for a write cycle about 23 microseconds, for an erase cycle about 16 microseconds, and for a bulk-erase cycle only about 8 microseconds. The typical 20 microsecond period is, therefore, a compromise for the four control functions. Increasing the period for each of the four functions to the 23 microseconds taken by the write function would increase the stability of the plasma display panel after a write function, but it would cause the system to be approximately 15% slower due to the longer period of time required to perform each function. The 20 microsecond period decreases the stability of the plasma display panel after a write function somewhat, an acceptable compromise.

A more significant problem is the fact that prior art systems bear the constraint of having a fixed time base, this fixed time base allowing only one fixed cycle length of 20 microseconds. If the lengths of the four control functions could differ, each of the functions could be done in the minimal time required, thus yielding both a higher data rate and a better write function.

It is also desirable to be able to add a new function which has a length greater than the fixed cycle length of 20 microseconds, such as the distributed conditioning pulse, which is the subject of copending U.S. patent application Ser. No. 273,093, filed on June 12, 1981, entitled: Distributed Conditioning For An AC Plasma Panel, by Joseph T. Suste and Michael J. Marentic. Since the distributed conditioning function takes more than 20 microseconds to perform, two 20 microsecond periods must be chained together to give a compound mode of length 40 microseconds. In order to perform the operation, extra logic for the ROM address lines is necessary to execute the two 20 microsecond component periods sequentially. It may be desirable to have other functions which also take a greater length than the standard 20 microsecond period. Therefore, it may be seen that the use of a fixed time base having a 20 microsecond period does not allow sufficient flexibility to operate sophisticated plasma display systems.

One possible solution is to increase the length of the period. This solution presents several problems of its own. First, the maximum update rate would be reduced by an amount directly proportional to the increase in the period of the cycle. Also, if only one sustain cycle is run in the increased period, the brightness of the display would be reduced, since only two pulses of light would be emitted from the display in the increased period.

Another major problem caused by the fixed 20 microsecond time base is that large scale parallel addressing is not possible. It is highly desirable to address an entire line, comprised of the 512 cells along an X-electrode, simultaneously. However, the time required to load the data necessary to address 512 cells is at least 71 microseconds to prepare the drive circuitry for a write or erase operation. Five complete sustain operations can be done in a period of 75 microseconds, providing sufficient time for loading data. A write function, done properly, takes 23 microseconds, so it may be seen that a period of approximately 98 microseconds or more is required in order to parallel address 512 cells. If a fixed period of 100 microseconds is adopted, 512 cell parallel addressing would be possible, but at a substantial cost.

Since the sustain and bulk-erase cycles would have the same period, to prevent complex addressing circuitry from being required, there would be a substantial delay in addressing, i.e. performing write or erase operations, if a sustain function was being executed at the time.

A major consideration in the design of plasma display panel systems is the amount of ROM memory storage space required, since larger amounts of memory increase both the cost and complexity of the system. The basic system described above, with only write, erase, sustain, and bulk-erase functions, at a fixed 20 microsecond period, needs only about 1K of memory.

If another function is to be added to the system, the amount of required memory is doubled. For a complex function, such as distributed conditioning, described in the above-referenced copending patent application, to be added to the system, the memory space in the ROM must be quadrupled, and external control logic must be added to access these new locations in the ROM.

If 512 cell parallel addressing is desired, the minimum period for a cycle that would allow 512 cell parallel addressing is about 100 microseconds. Each of the pulse trains stored in the ROM would have to be 100 microseconds long, 5 times the length of the basic system. Therefore, in order to add a 512 cell parallel addressing feature to the basic plasma panel system, the memory required would be 5 times the minimum memory of 1K, since the address groups are 5 times as long as the previous 20 microseconds, and thus 5K of memory would be required. If it is desired to parallel address 512 cell locations, and to also have a distributed conditioning feature, the memory capability must be further expanded.

Another desirable feature in a plasma panel is brightness control. The addition of brightness control expands the ROM by a factor equal to the number of brightness levels desired, typically 8. If brightness control is desired in a system with more than the basic four control functions, and 512 cell parallel addressing is also desired, the amount of memory required becomes prohibitively large, as demonstrated by the following example. For a system with 8 different control functions and 8 brightness levels, with a 120 microsecond period (required for 8 level brightness control), the amount of memory required is 384 address$\times$8 modes$\times$8 brightness levels$\times$5 outputs (required for distributed conditioning)=120K. This size of memory is simply too expensive to be considered. Thus, if it is desired to have constant data rate brightness control in combination with sophisticated operating modes, an alternative system is required.

SUMMARY OF THE INVENTION

The present invention alleviates the above problems by forming the required waveforms as sequences of a small number of elemental waveform parts, called modules. Thus, the system generates short, elemental modules, and uses these modules as building blocks, stringing them together in different orders to provide a variety of waveforms to perform the required functions.

The modules used include a positive discharge module, a negative discharge module, a blank sustain module, a write module, an erase module, a bulk-erase module, a short sustain equilization module, a long sustain equilization module and a distributed conditioning module. In order to form a complete waveform which performs a function on the plasma panel, a number of modules are assembled into the complete function.

For example, to generate a sustain waveform, two modules are used. The first module is a negative discharge module, and the second module is a positive discharge module. In this way, the sustain function is assembled from two smaller modules so that the sustain operation will be performed in a minimum time.

A write function is generated by a positive discharge module and a write module. The positive discharge module is the same module used as the second module in the sustain function above. In addition, if the write function is immediately preceded by a sustain function, the initial positive discharge module, used in the write function, is not necessary. An erase function is generated by an erase module and a positive discharge module. A bulk-erase module is used to provide the complete bulk-erase function. Other functions, such as distributed conditioning brightness control, may be performed by the addition of a single extra module to perform each additional function.

512 cell parallel addressing can be done by forming a string of sustain pulses, for a period of time sufficient to enable addressing information to be loaded into the driver chips, and then by causing a write or erase module to be generated. Since it takes approximately 71 microseconds to load the data into the driver chips, five sustain modules of 15 microsecond duration would provide sufficient time for the information to be loaded. In order to complete the function, a write or erase module follows the sustain pulses, performing the write or erase function. The erase module must be followed by a sustain equilization module and then a positive discharge module, since each string of pulses must end with a positive charge pulse.

Because each function occurs in the minimum cycle time required, the addressing rate of the system is maximized. This permits 512 cell parallel addressing while, actually increasing the panel data update rate.

Modular waveforms are generated by using two ROMs that are cascaded. These ROMs include a module generator ROM, which operates at a fast access time, and a string generator ROM, which operates at a slow access time. The module generator ROM is capable of generating each of the modules described above. The string generator ROM indicates to the module generator ROM which modules it is to generate, and will cause the module generator ROM to generate a desired group of modules sequentially, forming a complete function.

By generating basic components of the waveform in modules, each individual component operation is executed in the minimum time required. This not only has the effect of improving the data rate of the system, but also provides an optimum write function which was not possible in the system operating with a fixed 20 microsecond period.

The memory required by a complex system not using modular waveform generation techniques would be prohibitively large. In order to have 8 levels of brightness control, 8 different control functions, 5 different outputs, and 512 cell parallel addressing, 120K of memory would be required. The module generator ROM of the present invention requires 2.5K of memory, and the string generator ROM requires 10K of memory, for a total requirement of 12.5K memory storage space.

In addition, the system of the present invention does not require complex external control logic, but requires only two counters and two latches in addition to the two ROMs.

The amount memory utilized has been minimized, thus keeping the overall cost of the system as low as possible. In addition, the system of the present invention calls for considerable flexibility, and is easily expandable for additional operational modes.

RELATED APPLICATIONS

This specification is one of a group of specifications on plasma display technology, all assigned to the present assignee, including: System For Driving AC Plasma Panel, Ser. No. 166,579, filed Jul. 7, 1980, by Joseph T. Suste; MOSFET Sustainer Circuit For An AC Plasma Display Panel, Ser. No. 258,757, filed Apr. 29, 1980, by Larry F. Weber; Constant Data Rate Brightness Control For An AC Plasma Panel, Ser. No.273,095, filed Jun. 12, 1981, by Joseph T. Suste; Distributed Conditioning For An AC Plasma Panel, Ser. No. 273,093, filed Jun. 12, 1981, by Michael J. Marentic and Joseph T. Suste; Plasma Display Panel Drive Electronics Improvement, Ser. No. 272,885, filed Jun. 12, 1981 by Michael J. Marentic; and Advanced Waveform Techniques For Plasma Display Panel, Ser. No. 273,094, filed Jun. 12, 1981, by Michael J. Marentic.

DESCRIPTION OF THE DRAWINGS

These and other advantages of the present invention are best understood through reference to the drawings, in which:

FIG. 2*a* is a chart showing the ROM addresses and the functions performed for a given mode control input for the logic circuitry of FIG. 2;

DESCRIPTION OF THE PREFERRED EMBODIMENT

Figure 1:
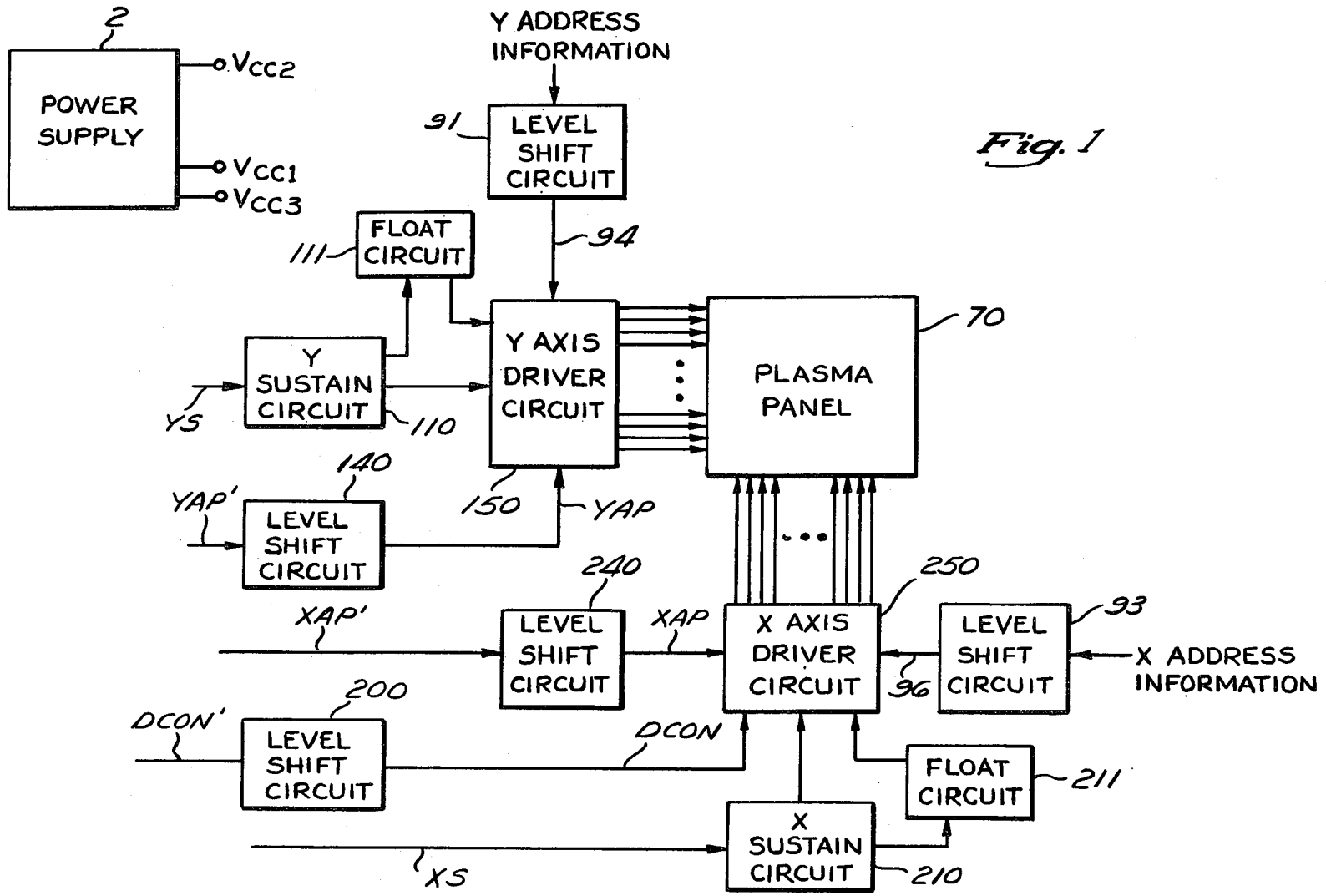
FIG. 1 is a block diagram of a conventional system with sustainer and driver circuitry controlling an AC plasma panel.

A plasma panel 70, as shown in FIG. 1, is driven by an X-axis driver circuit 250 and a Y-axis driver circuit 150. The circuitry of FIG. 1 is described in detail in the above-identified copending application entitled "Distributed Conditioning For An AC Plasma Panel", which is incorporated herein by reference. A general description is provided below, to aid in the understanding of the present invention.

A pair of sustain circuits 210 and 110 are used to provide the sustain signal to the driver circuits 250 and 150, respectively. Float circuits 211 and 111 are used to supply floating supply levels of $V_{CC1}$, the low voltage used to power the logic circuitry, and $V_{CC2}$, the high voltage used to drive the panel, to the circuits 250 and 150, respectively. The X-axis sustain circuit 210 is controlled by an X-sustain signal XS, and the Y-axis sustain circuit is controlled by a Y-sustain signal YS. The addressing of individual cells of the panel 70, to accomplish selective writing and erasing of these cells, is controlled by an X-address pulse XAP and a Y-address pulse YAP, supplied from a waveform ROM (Read Only Memory, not shown in FIG. 1) through a pair of level shift circuits 240 and 140, which are required, since the driver circuits 250 and 150 operate on floating grounds. The X-address information and Y-address information is supplied to the driver circuits 250 and 150 through a pair of level shift circuits 93 and 91, respectively, and identifies which cells on the plasma panel 70 are to receive the X and Y address pulses.

FIG. 1 also shows a distributed conditioning signal DCON supplied to the X-axis driver circuit 250 via a level shift circuit 200. The distributed conditioning operation is described in the above-identified copending application, "Distributed Conditioning For An AC Plasma Display Panel."

Figure 2:
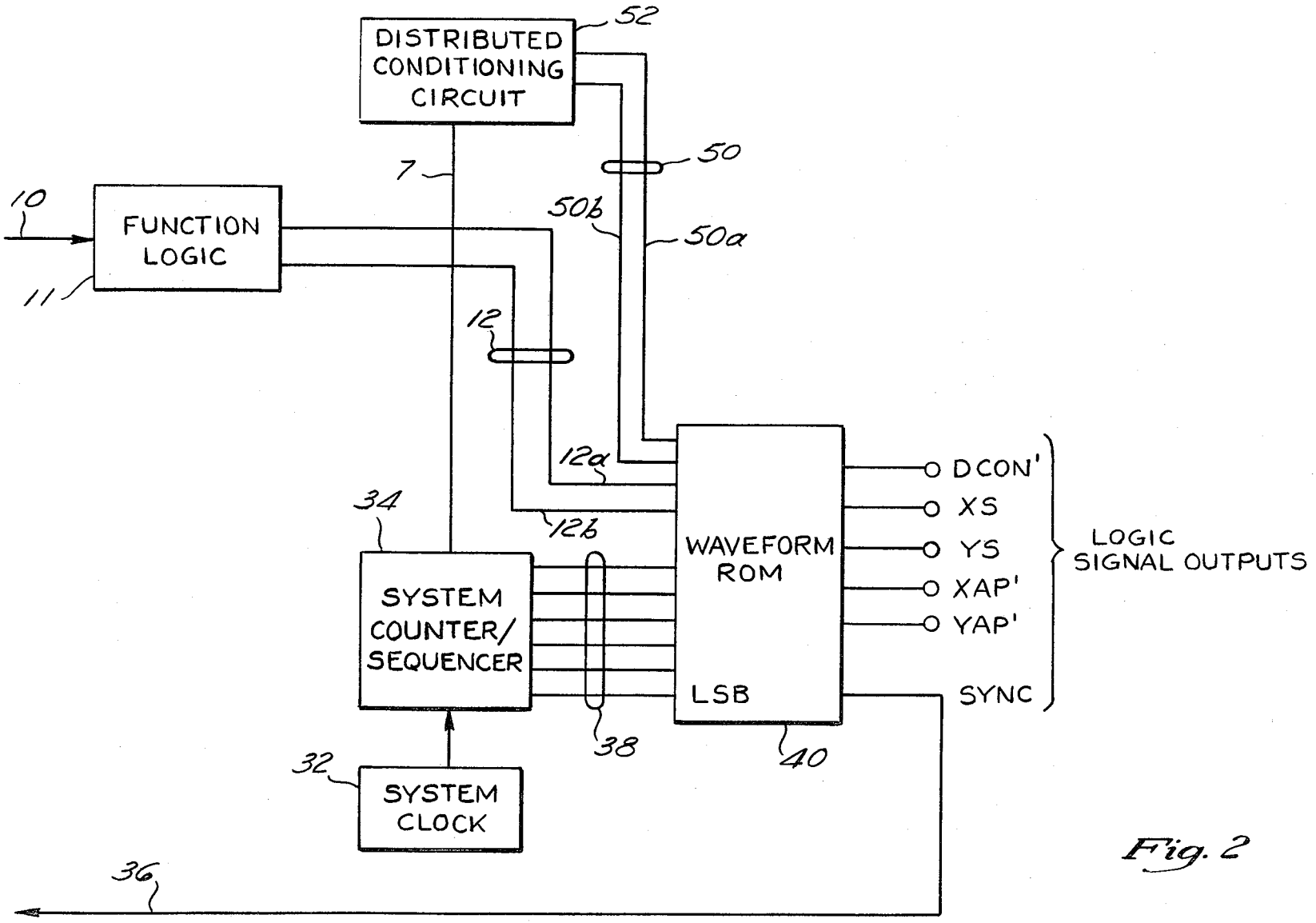
FIG. 2 is a block diagram of the conventional logic circuitry for providing the logic signal outputs which control the sustainer and driver circuitry of the system in FIG. 1.

A waveform ROM 40 and its addressing circuitry are shown in FIG. 2. A distributed conditioning input 50 and a mode control input 12 determine which of 16 address groups in the waveform ROM 40 will be accessed. The distributed conditioning input 50 is generated by a distributed conditioning circuit 52 and comprises 2 address bits, 50*a* and 50*b*, supplied to the waveform ROM 40. These two bits form the most significant address bits for the ROM 40, and determine whether the address group which is to be accessed is in address groups 1 through 4, 5 through 8, 9 through 12, or 13 through 16, as shown by the chart in FIG. 2*a*. The two next most significant address bits for the waveform ROM 40 are bits 12*a* and 12*b*, which are generated by a function logic circuit 11. These bits 12*a* and 12*b* determine which of the four basic functions (bulk-erase, erase, write, or sustain) will be implemented, as shown in FIG. 2*a*.

It may be seen from the chart in FIG. 2*a* that each of the address groups have 64 addressable data words, as shown in the column marked "ROM Address." Sequencing through these 64 addresses is controlled by timing information 38, supplied by a system counter/sequencer 34, and a system clock 32, shown in FIG. 2. The chart in FIG. 2*a* shows, under the heading "Function", the operations that will be performed for each of the 16 address groups.

The waveform ROM 40 supplies the 5 logic signal outputs controlling the sustainer and driver circuitry of FIG. 1: an X-sustain signal XS, a Y-sustain signal YS, an inverse X-address pulse XAP', an inverse Y-address pulse YAP', and an inverse distributed conditioning pulse DCON'. The latter three pulses are in inverse form since the level shifters used in the circuitry of FIG. 1 will invert them. The level shifters of FIG. 1, 240, 140, and 200, are well-known, and may comprise, for example, optical isolators or transformers. The single ROM system described above is designed to operate at a fixed frequency, typically 50 kHz. This type of system has all of the drawbacks and disadvantages described above.

The present invention uses a modular waveform generation circuit in place of the circuitry of FIG. 2. The invention separates each of the waveforms used to address the plasma panel into modules. By combining these modules in different sequences, any desired waveform may be generated. Each module begins and ends with no discharge activity taking place, and the applied cell voltage Y - X is at the AC zero voltage level at the beginning and end of each module. This requirement enables any module to follow any other module.

Figure 3:
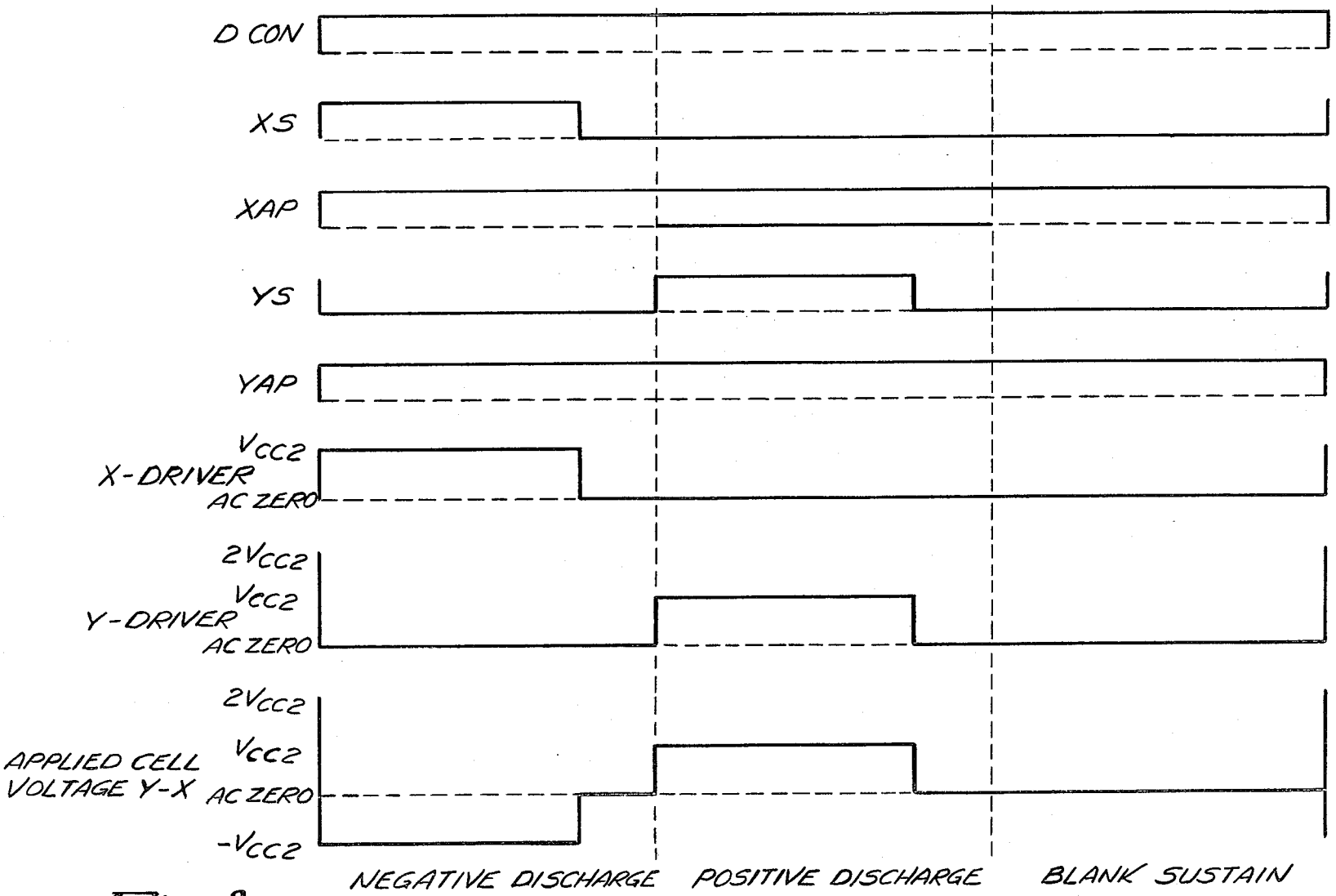
FIG. 3 shows the applied cell voltage Y - X, the Y-driver voltage, the X-driver voltage, and the logic signal outputs supplied by the present invention for a positive discharge module, a negative discharge module, and a blank sustain module.
Figure 4:
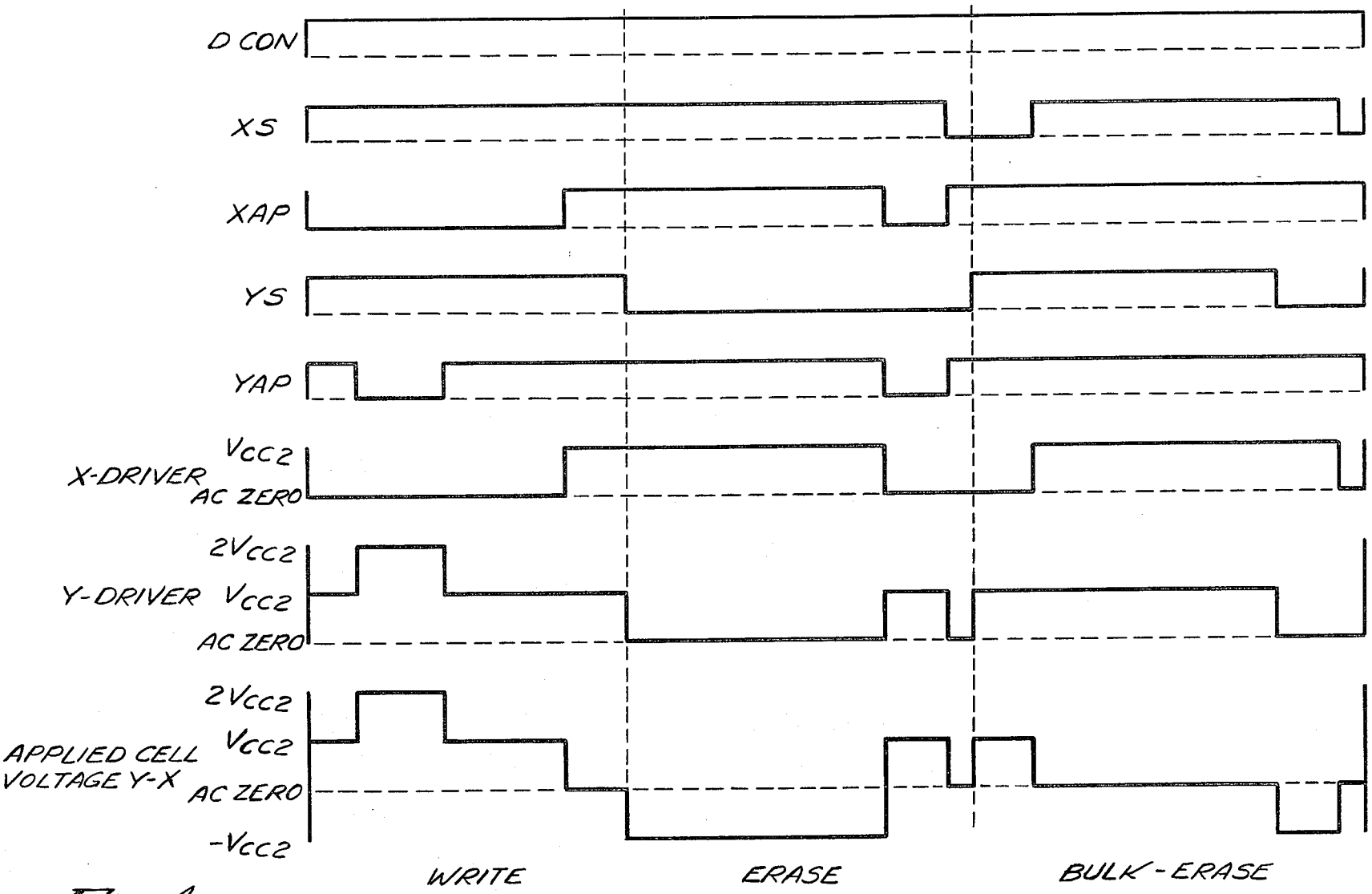
FIG. 4 shows the applied cell voltage Y - X, the Y-driver voltage, the X-driver voltage, and the logic signal outputs supplied by the present invention for a write module, an erase module, and a bulk-erase module.
Figure 5:
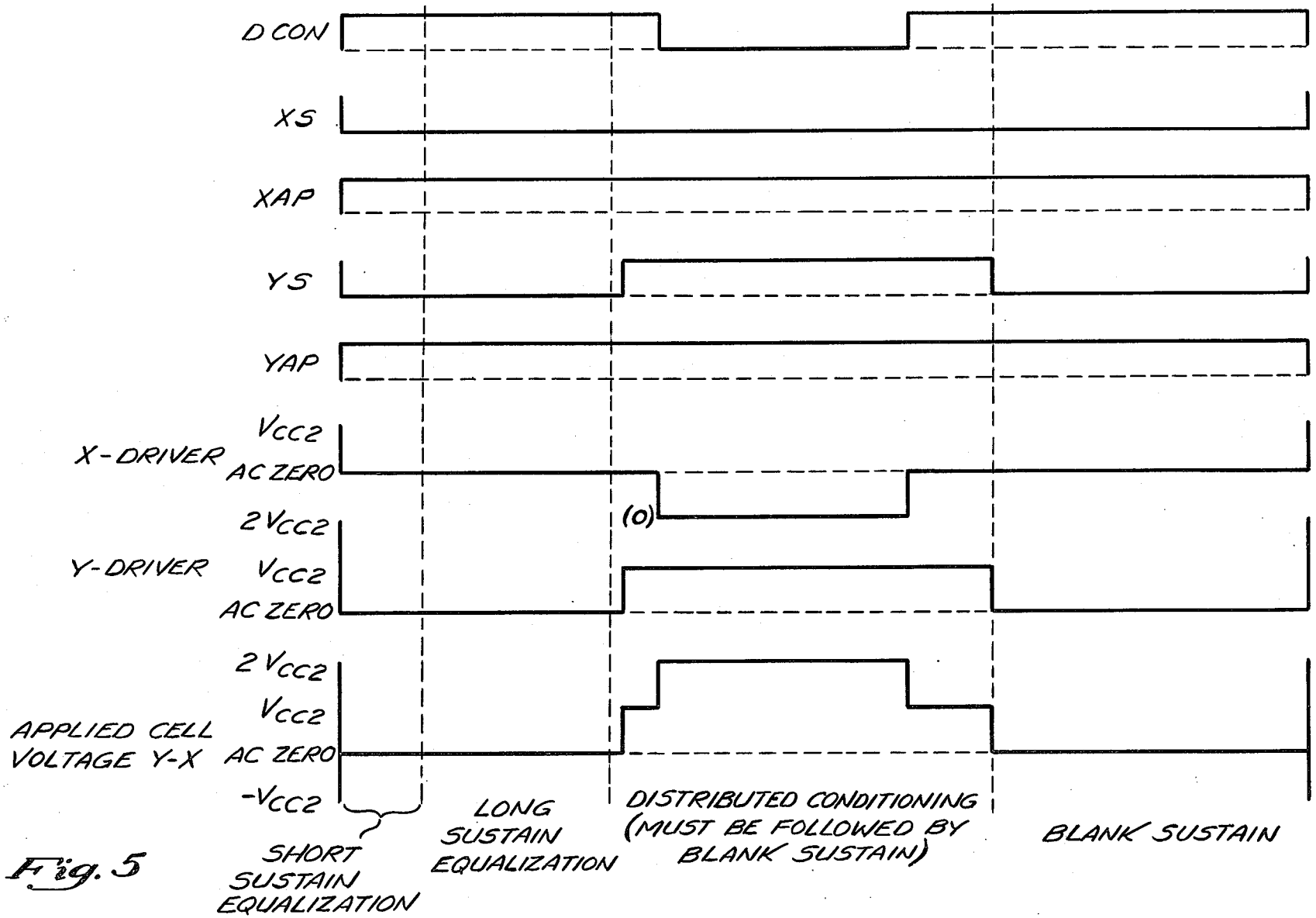
FIG. 5 shows the applied cell voltage Y - X, the Y-driver voltage, the X-driver voltage, and the logic signal outputs supplied by the present invention for a short sustain equilization module, a long sustain equilization module, a distributed conditioning module, and the blank sustain module which must follow the distributed conditioning module.

The modules used by the present invention to generate waveforms to address the plasma panel, are shown in FIGS. 3–5. The logic signals shown in these figures (DCON, XS, XAP, YS, AND YAP) are supplied to the sustain and driver circuits 110,210,150,250 shown in FIG. 1 which, in response, generate the waveforms X-driver, Y-driver shown in FIGS. 3–5. These waveforms cooperate to generate, at the plasma panel 70, the applied cell voltage Y - X, which performs the functions indicated.

The first module in FIG. 3 is a negative discharge module. The second module is a positive discharge module. A negative discharge module and a positive discharge module are the two components required to perform the sustain function. When a negative discharge module is followed by a positive discharge module, a single sustain cycle is generated. The negative discharge module and the positive discharge module are also used as components of other functions, when combined with other modules.

The third module shown in FIG. 3 is the blank sustain module, which is used for brightness control. Since the brightness control concept for use with the modular waveform generator of the present invention has a different inventor, it is discussed in the above-referenced copending application entitled, "Advanced Waveform Techniques For Plasma Display Panels."

The first module in FIG. 4 is a write module. When the write module is preceded by a positive discharge module (FIG. 3), a complete write function will be performed. If a sustain function immediately precedes the write function, the positive discharge module is not necessary, since a sustain function ends with a positive discharge module.

The second module in FIG. 4 is an erase module, and when followed by a positive discharge module, a complete erase function will be performed. The positive pulse of the positive discharge module is necessary, following the erase module, because each string of modules comprising a function must end with a module producing a positive pulse so that the first pulse of a succeeding sustain function will produce a discharge of light. A positive pulse is produced by positive discharge, write, and distributed conditioning modules.

The final module shown in FIG. 4 is the bulk-erase module. This module alone will perform the bulk-erase function. Since it is comprised of two very short pulses, which pulses erase the entire display, a succeeding sustain function will not produce a pulse of light in any case. Thus, it is not necessary to follow the bulk-erase module with a positive pulse producing module; therefore, the bulk-erase module is an exception to the requirement of ending a function with a positive pulse producing module.

In FIG. 5, the first two modules shown are a short sustain equilization module and a long sustain equilization module. These two modules are characterized by an applied cell voltage Y - X at the AC zero voltage level, and are used for spacing purposes. These spaces are required when it is necessary to have a string of modules in a certain time period, and are most commonly used for brightness control systems which are capable of addressing 512 cells, as will be described later.

The third module shown in FIG. 5 is a distributed conditioning module. The distributed conditioning function eliminates the need for border sustainers by periodically discharging all of the cells in the panel, and is discussed in the above-referenced copending application, "Distributed Conditioning For An AC Plasma Display Panel." In order to perform a distributed conditioning operation, the distributed conditioning module must be followed by a blank sustain module, as shown in FIG. 5. The distributed conditioning module must be preceded by a positive discharge module, but this positive discharge module may be the last module of the preceding operation.

Figure 7:
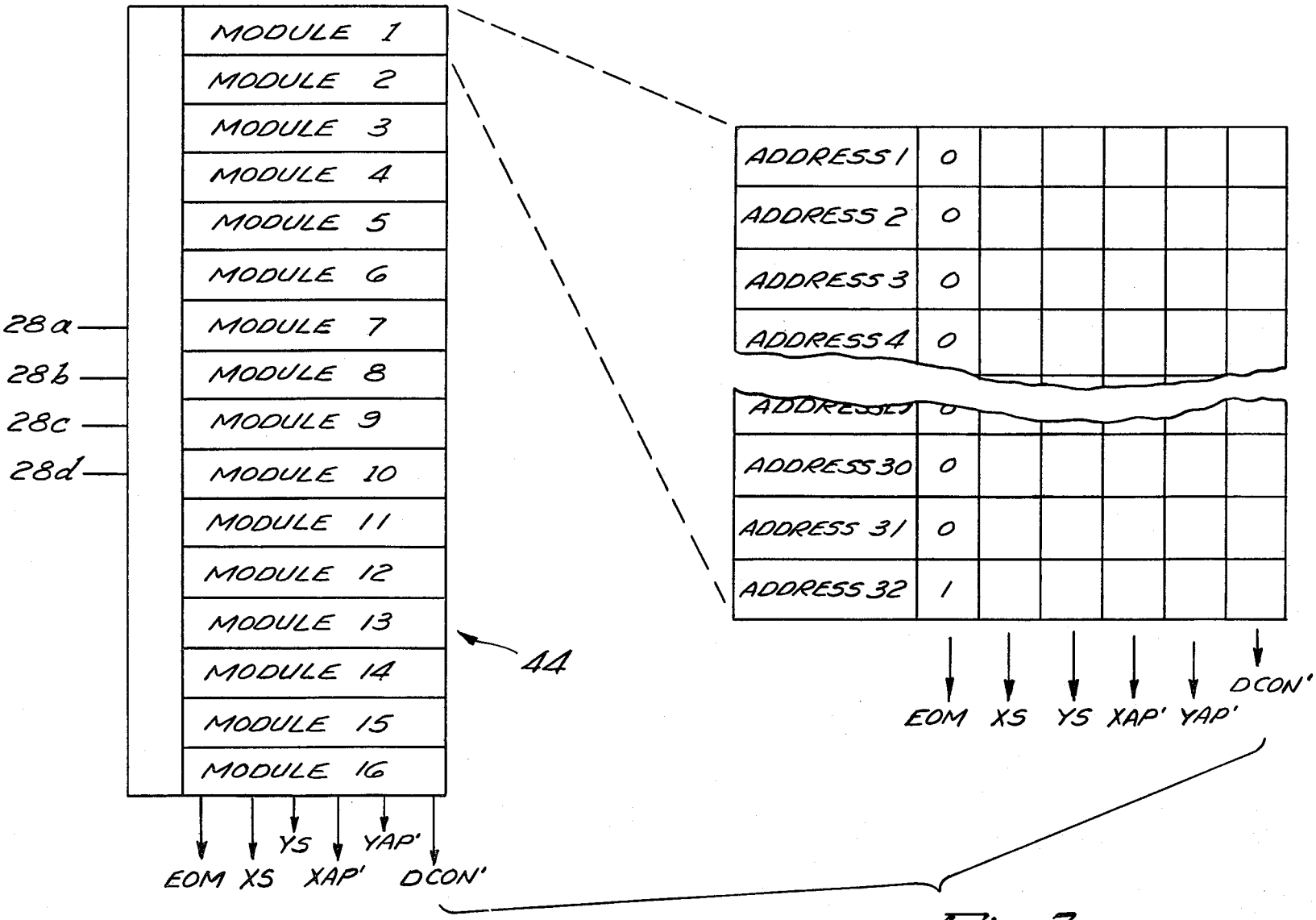
FIG. 7 is a schematic diagram of a digital memory device storing 16 modules, each module having 32 addressable locations, for generating logic signal outputs causing one of the basic module operations shown in FIGS. 3–5 to be executed on a plasma panel.

While only 9 modules have been disclosed, the system of the present invention has the capability of storing 16 different modules. When any one of these modules is accessed, the system must output the 5 logic signals (XS, YS, XAP', YAP', and DCON') which will cause the waveform generated by that module to be executed on the plasma display panel. FIG. 7 shows, schematically, a module generator ROM 44 storing information to perform 16 different modules. Module 1 is shown to have 32 address locations, and the operation performed by module 1 will be executed by stepping through these locations, in order, to produce binary bit patterns which define the logic signal outputs. An additional signal generated by each of the modules is the "end of module" signal EOM. This signal is necessary, since different modules require different time periods.

For example, in order to produce a short sustain equilization module, only 7 of these address locations are utilized. However, in order to perform the longer distributed conditioning function, all 32 of the address locations are needed. Since each module will be performed in the minimum amount of time required, the end of module signal EOM, is necessary to indicate that the module is completed. Therefore, the EOM bit for all but the last address location utilized will have a 0 logic level. For the last address location utilized, the EOM bit will be 1, indicating that the operation performed by the module is complete.

Figure 8:
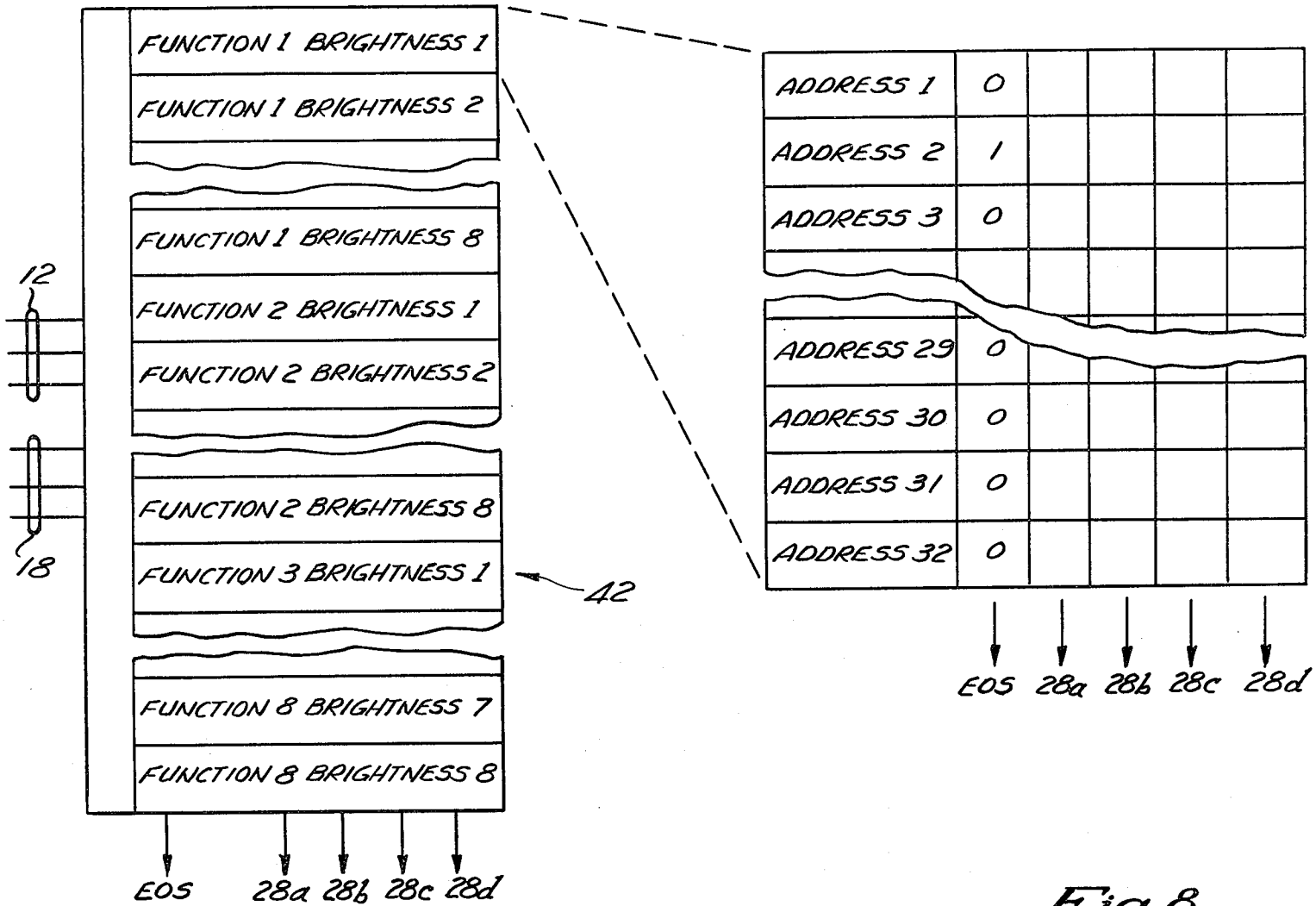
FIG. 8 is a schematic diagram of a digital memory device having 64 address groups, each group having 32 addressable locations, for causing a selected group of modules from the device in FIG. 7 to be sequentially accessed.

Since there are 16 different modules, four address bits 28*a*, 28*b*, 28*c* and 28*d* are required to select one of the 16 modules. These address bits 28*a*, 28*b*, 28*c*, and 28*d*, are provided by a string generator ROM 42, shown schematically in FIG. 8. The string generator ROM 42 sequentially addresses groups of modules from the module generator ROM 44 to assemble a string of modules into a complex waveform. The string generator ROM 42 is shown to provide 8 functions, each at 8 brightness levels, requiring a total of 64 address groups. Each of these address groups contains 32 address locations, each identifying a module. Thus, each string may include up to 32 modules. In other words, each of the addressable locations stores address bits 28*a*, 28*b*, 28*c*, and 28*d* which identify 1 module, and cause that module to be executed.

There is an additional logic signal output, the "end of string" signal EOS. When the EOS signal is at a logic level of 1, it indicates that the last module, in the string is being generated. For example, if a sustain function is being generated, a negative discharge module and a positive discharge module must be produced. Since there are only two modules in the basic sustain function, addressable location 2 would have a 1 bit for the EOS logic signal.

Figure 6:
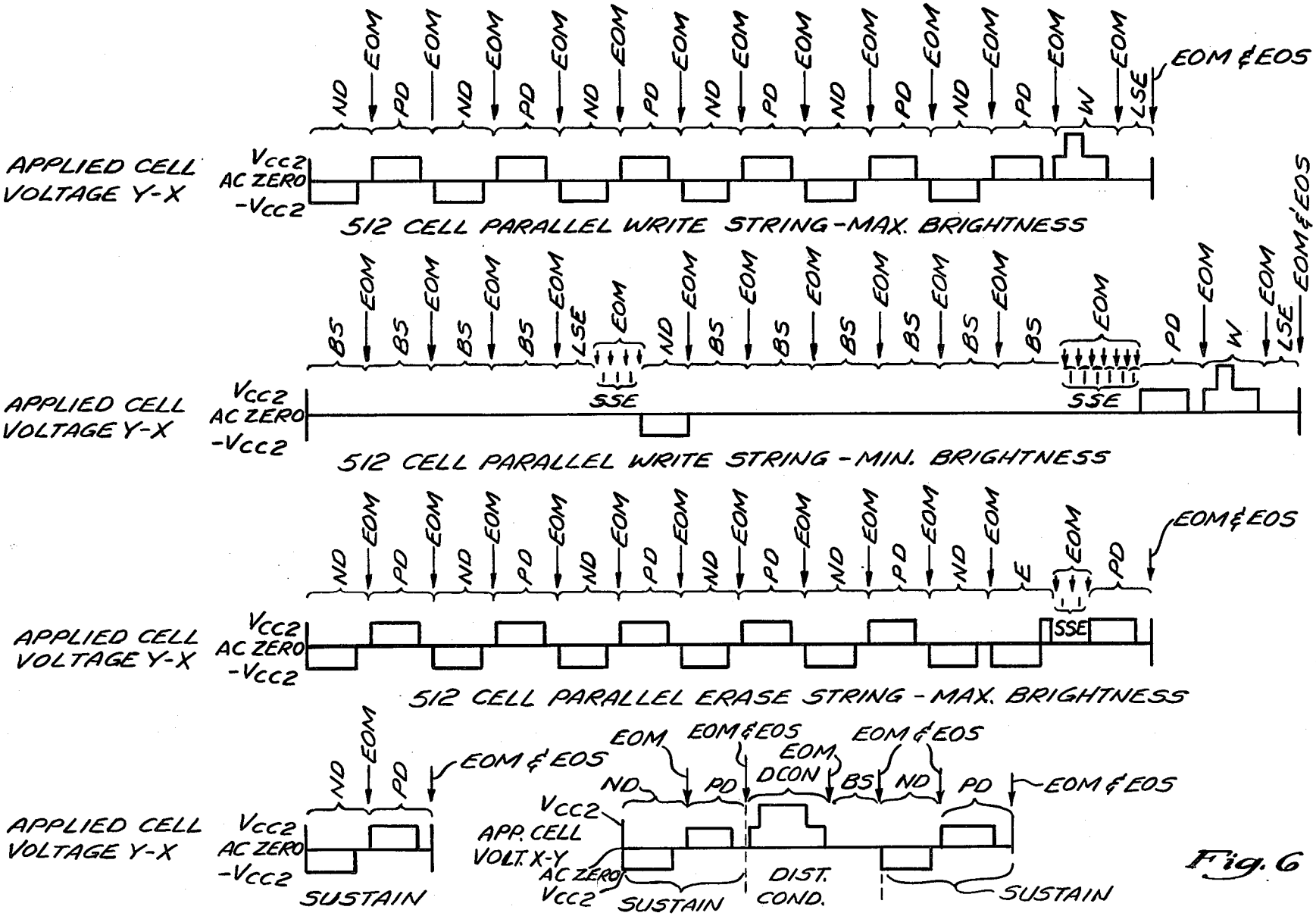
FIG. 6 shows the assembled string for 512 cell parallel addressing write and erase functions, for the sustain function, and for the distributed conditioning function, the assembled strings being composed of the modules shown in FIGS. 3–5.

Referring now to FIG. 6, a number of examples will be utilized to describe the use of modules to assemble functional strings. In a first example, a distributed conditioning function, assembled from a distributed condition module (DCON) and a blank sustain module (BS), is shown preceded by a sustain function. The sustain function is assembled from a negative discharge module (ND) and a positive discharge module (PD). Since the last module of the sustain function is a positive discharge module, the distributed conditioning function may follow the sustain function without requiring an additional positive discharge module.

The blank sustain module (BS) following the distributed conditioning module (DCON), and completing the distributed conditioning function, generally is followed by a negative discharge module (ND), as shown in FIG. 6, where the negative discharge module (ND) following the distributed conditioning function is the first module of a sustain function. It should be noted, however, that it is only typical, and not mandatory, that a negative discharge module (ND) follows the distributed conditioning function.

A second example provided by FIG. 6 is the sustain function. A negative discharge module (ND) will be generated, and at the last point in that module, an "end of module" signal EOM will be generated. As can be seen from FIG. 6, each module ends with an EOM signal, which causes the system to access the next module from the ROM 44. In the case of the sustain function being described, this next module is a positive discharge module (PD). When the positive discharge module has been generated, an "end of module" signal EOM and an "end of string" signal EOS are generated. As can be seen from FIG. 6, each function ends with an EOS signal, which causes the next function to be accessed from the string ROM 42. By using this technique, the basic functions may be executed in the minimum amount of time required.

In order to perform a 512 cell parallel addressing operation, a period of at least 71 microseconds is required for loading addressing data into the driver circuits. Therefore, if a write or erase function is to be performed, a string of modules will be assembled as shown in the remaining examples of FIG. 6. For a period of at least the 71 microseconds required to load the data, sustain functions composed of positive discharge (PD) and negative discharge (ND) modules will be assembled. After a time sufficient to load the data, a write (W) or erase (E) module is accessed. 512 cell parallel write strings are shown in FIG. 6 for both maximum and minimum brightness. For maximum brightness, there are 6 complete sustain functions followed by a write module (W) and a long sustain equilization module (LSE). During the time that the sustain functions are being executed, data is being loaded into the driver circuits. Then, near the end of the string, the 512 cell parallel write module (W) is accessed.

For a minimum brightness level string performing the 512 cell write operation, most of the negative discharge (ND) modules and positive discharge (PD) modules are removed, substituting blank sustain (BS), long sustain equilization (LSE), and short sustain equilization (SSE) modules. It can be seen that one complete sustain function will be performed before the write module (W) is accessed. In addition, the cycle shown for minimum brightness is extended to 120 microseconds, rather than the 100 microseconds of the maximum brightness string. Making the string longer with the same number of light emissions, of course, has the effect of further reducing the overall light emitted from the plasma display panel 70.

FIG. 6 also shows a 512 cell parallel erase string, for maximum brightness. There are 5 complete sustain functions, followed by a negative discharge module (ND), and the erase module (E). There are then two short sustain equilization modules (SSE), and a positive discharge module (PD) to end the string with a positive pulse. The requirement for this positive pulse was discussed above.

The total time for a write or erase operation is approximately 102 microseconds. In this time period, 512 cells may be written. With non-module systems, 16 cells could be written in a period of 20 microseconds. Therefore, it may be seen that this system performs a write or erase function approximately 6.4 times faster than such systems. Even when the system is operating at the minimum brightness level shown in FIG. 6, and the write or erase function takes 120 microseconds to be performed, the system of the present invention is approximately 5.3 times faster than non-module systems. Therefore, the overall data rate of the system of the present invention is at least 5.3 times higher than the data rate systems which do not include the present invention.

Figure 9:
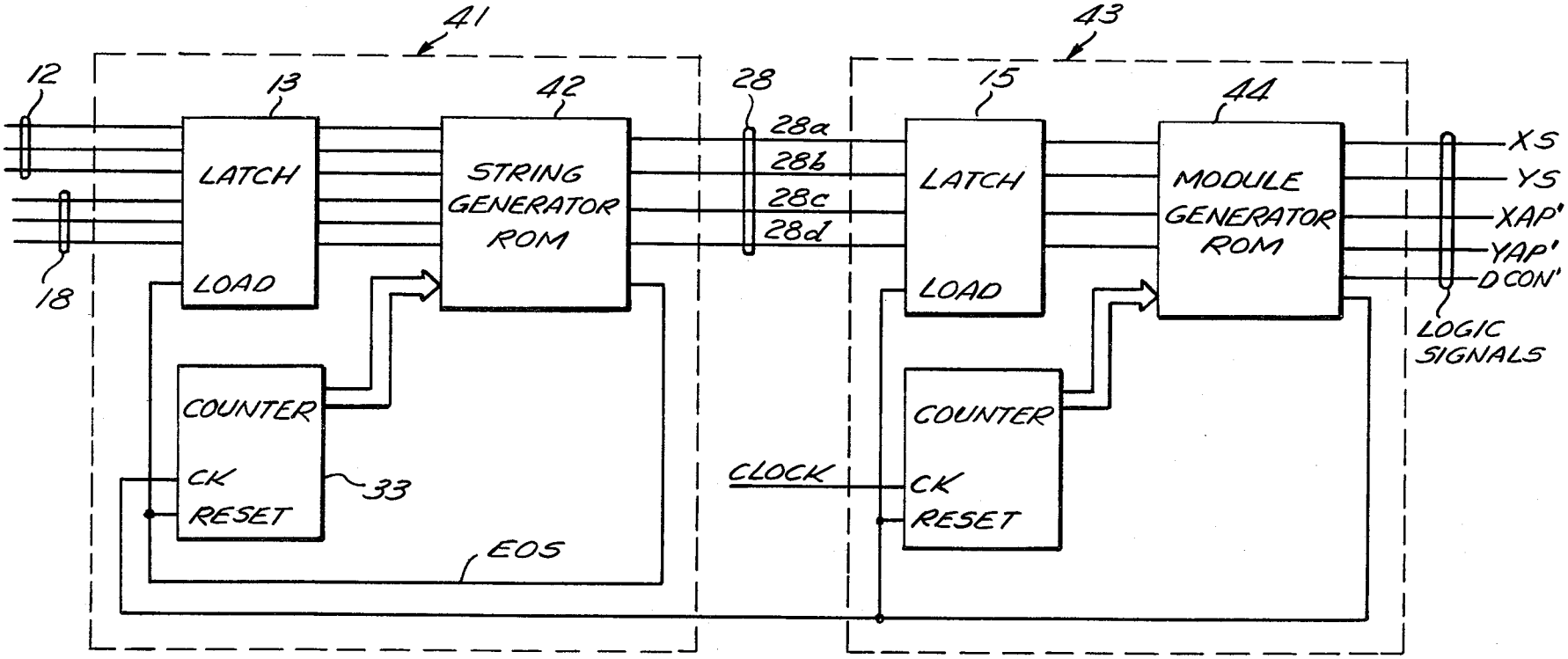
FIG. 9 is a block diagram schematic of the components of the present invention used to provide the logic signal outputs shown in FIGS. 3–5.

The actual circuitry used to form the modules and to assemble the strings of modules is shown in FIG. 9. This circuit is used in place of the more common waveform ROM 40 shown in FIG. 2. There are two main components to the system: a string generator 41, and a module generator 43. The module generator 43 includes, as a component, the module generator ROM 44 shown in FIG. 7, and generates the individual modules described above. The string generator 41 includes, as a component, the string generator ROM 42 shown in FIG. 8, and assembles the modules in a desired string to perform whatever function is to be executed.

The operation of the module generator 43 is as follows. Module address information 28 (bits 28*a–d*) is supplied by the string generator 41, and defines which module is to be generated. This information is supplied via a latch 15 to the module generator ROM 44 when the previous module has been completed. The module generator ROM 44 will then output logic signals (XS, YS, XAP', YAP', DCON') which will cause the driver and sustainer circuitry (FIG. 1) to execute the desired module. The module generator ROM 44 is clocked through its addressable locations by timing information from a counter 35.

When a module has been completed, an end of module signal EOM will be output from the module generator ROM 44 as described above. This signal is supplied to the counter 35, causing it to reset. The EOM signal is also supplied to the latch 15, causing it to clock an address into the module generator ROM 44 defining the next module to be accessed in the string. Since the counter 35 has been reset, information from the next module will be accessed beginning at the first addressable location in that module.

These modules are assembled into strings by the string generator 41. When a module has been generated and the End of Module signal EOM is supplied by the module generator ROM 44, the EOM signal is used as a clocking pulse for a counter 33. Each time the counter 33 receives this End of Module signal EOM, it will increment and cause the string generator ROM 42 to output address information 28 defining the next module to be executed. If the address information 28 defines the last module in the string, an End of String signal EOS is generated by the string generator ROM 42. This End of String signal EOS causes the counter 33 to reset, and the latch 13 to provide to the string generator ROM 42 an address defining the next string which is to be performed.

This address comprises the two inputs to the system: a brightness control input 12, and a mode control input 18. The module generation system shown in FIG. 9, to provide 512 cell parallel addressing with brightness control as described above, would require a string generator ROM memory of 10K, and a module generator ROM of 2.5K, for a total memory requirement of 12.5K. The use of a non-modular system with such capability would require 120K of memory. It can be seen that, as more functions are added, and more brightness levels are used, the memory savings will be multiplied.

The modular waveform generator system described in this specification may also be used to perform a distributed conditioning function, as shown by the distributed conditioning string in FIG. 6. Since the distributed conditioning concept has a different inventor, that concept is covered in a copending application. The module waveform generator technique can also be used to implement an improved brightness control system, but since the concept of the improved brightness control system also has a different inventor, that concept is also covered in a copending application.

The module waveform generator technique has provided a means by which to vary the time base to optimize each function being performed. In this way, the data rate of the system is increased and the performance of each of the functions has been optimized.

Thus, the system is capable of parallel addressing 512 cells, and by doing so, the data rate of the system is increased by more than 5.3 times. In addition, the modular waveform generator system is easily expandable for additional operating functions.

The amount of memory used has been minimized. The modular waveform generator system described in the preferred embodiment uses less than 1/9th the memory of non-modular systems, and it does not need nearly as sophisticated an addressing system.

I claim:

1. An AC plasma panel system, comprising:

a plasma panel driver circuit; and means for providing input waveforms for said driver circuit, said means comprising:

means for providing waveforms of different arbitrary lengths, each of said waveforms of different arbitrary lengths for accomplishing a different function on said panel, wherein one of said functions is a write function and another of said functions is a sustain function.

2. An AC plasma panel system as defined in claim 1 wherein said means for providing waveforms of different arbitrary lengths comprises:

first and second memories, said first memory addressing said second memory.

3. An AC plasma panel system as defined in claim 2 wherein said second memory stores data defining elemental waveform components and wherein said first memory stores data defining combinations of elemental waveform components for providing said waveforms of different arbitary lengths.

4. An AC plasma panel system as defined in claim 3 wherein two of said combinations of elemental waveform components include identical elemental waveform components.

5. An AC plasma panel system as defined in claim 1 wherein said waveforms of different arbitrary lengths accomplish a write function on said AC plasma panel in a time period greater than 20 microseconds and a sustained function on said AC plasma panel system in a period shorter than 20 microseconds.

6. An AC plasma panel system as defined in claim 1 wherein said different functions comprise a write, erase, sustain and bulk-erase function.

7. An AC plasma panel system as defined in claim 6 wherein said different functions additionally comprise a distributed conditioning function.

8. An AC plasma panel system as defined in claim 7 wherein said different functions additionally comprise a variable brightness function.

9. A method of generating complex waveforms for an AC plasma panel, comprising:

storing data defining partial waveforms for writing and sustaining said panel; and accessing said data in a predetermined sequential order to define a waveform comprising plural ones of said partial waveforms.

10. A method of generating complex waveforms as defined in claim 9 wherein said partial waveforms include a positive discharge, negative discharge, write, erase and bulk-erase partial waveform.

11. A method of generating complex waveforms as defined in claim 9 additionally comprising:

generating a clocking signal at the completion of accessing of said data defining partial waveforms.

12. A method of generating complex waveforms as defined in claim 9 additionally comprising:

generating a clocking signal upon completion of accessing of said data in a predetermined order to indicate the completion of a waveform.

13. A method of generating complex waveforms as defined in claim 9 wherein said accessing step permits accessing of plural waveforms to permit the brightness of said AC plasma panel to be varied.

14. A method of generating complex waveforms as defined in claim 9 wherein said accessing step accesses said data in a pair of predetermined orders, said predetermined orders having different lengths.

15. A plasma panel waveform generator comprising:

a first memory storing elemental waveform components; and a second memory storing instructions for assembling said components in plural sequential orders into waveform strings.

16. A plasma panel waveform generator as defined in claim 15 in which said second memory addresses said first memory.

17. A plasma panel waveform generator as defined in claim 15 in which said elemental waveform components stored within said first memory have different lengths.

18. A plasma panel waveform generator as defined in claim 15 wherein said waveform strings include a variable number of said elemental waveform components.

19. A plasma panel waveform generator as defined in claim 15 wherein said first and second memories comprise read-only-memories.

20. A plasma panel waveform generator as defined in claim 15 wherein said first memory stores data defining an end to said elemental waveform components.

21. A plasma panel waveform generator as defined in claim 20 wherein said data defining an end of said elemental waveform components accesses data from said second memory.

22. A plasma panel waveform generator as defined in claim 15 wherein said second memory stores data defining the end of said waveform strings.

23. A plasma panel waveform generator as defined in claim 22 wherein said data defining the end of said waveform strings enables addressing of said second memory.

24. A modular waveform generator for a plasma panel, comprising:

first means for generating partial waveforms for operating said plasma panel; and second means for assembling said partial waveforms generated by said first means in plural sequential orders into strings to perform functions on said panel.

25. A modular waveform generator for a plasma panel as defined in claim 24 wherein said functions include write, erase and sustain functions for said plasma panel.

26. A modular waveform generator for a plasma panel as defined in claim 25 wherein said operations include common elements of said write, erase and sustain functions.

27. A modular waveform generator for a plasma panel as defined in claim 24 wherein said first and second means comprise read-only-memories.

28. An AC plasma panel waveform generator comprising:

means for providing a write and an erase waveform having a duration in excess of 71 microseconds; and means for providing a sustain waveform having a duration less than 20 microseconds.

29. A method of providing logic signals for controlling a plasma panel, comprising:

generating basic waveform components common to more than one function; and assembling at least two of said basic waveform components into a string to perform a function on said plasma panel.

30. A method of addressing an AC plasma panel, comprising:

writing new displays onto said panel during a data loading and writing period having a first duration; and periodically permitting initiation of said writing step at intervals shorter than said first duration.

31. A method of addressing an AC plasma panel as defined in claim 30 wherein said first duration is longer than 71 microseconds.

32. A method of addressing an AC plasma panel as defined in claim 30 wherein said second duration is shorter than 20 microseconds.

33. An AC plasma panel waveform generator, comprising:

means for driving electrodes in said panel in response to partial input waveforms assembled in sequential series; and means for generating, as said input waveforms, a write and a sustained waveform, each having a different duration, which duration is the minimum duration required to adequately perform its function.

* * * * *